United States Patent [19]

Taguchi et al.

[11] Patent Number: 4,513,877

[45] Date of Patent: Apr. 30, 1985

[54] CONTAINER HAVING SPRING BIASED HINGE

[75] Inventors: Toshio Taguchi; Hisashi Akino, both of Yokohama; Takamitsu Nozawa, Tokyo, all of Japan

[73] Assignees: Shiseido Co., Ltd.; Yoshino Kogyosho Co., Ltd., both of Tokyo, Japan

[21] Appl. No.: 626,904

[22] Filed: Jul. 2, 1984

[51] Int. Cl.[3] ..... B65D 43/24

[52] U.S. Cl. ..... 220/335; 16/256

[58] Field of Search ..... 220/335, 337, 241, 242; 16/255, 256, 257

[56] References Cited

U.S. PATENT DOCUMENTS

| | | | |
|---|---|---|---|
| 2,557,048 | 6/1951 | Haase | 220/335 |
| 2,583,350 | 1/1952 | Witzgall | 220/335 |
| 4,193,164 | 3/1980 | Okayama | 220/335 |

*Primary Examiner*—George T. Hall

*Attorney, Agent, or Firm*—Parkhurst & Oliff

[57] ABSTRACT

A container in which a recess for containing a coiled spring is formed at a shaft hole opening in a cover and a container. A connecting portion for connecting the other end of the coiled spring is formed at the other of the cover and the body in such a manner that the connecting portion is substantially oppositely formed to the recess at the shaft hole opening. A connecting piece capable of temporarily connecting the other end of the coiled spring is formed, and a packing elastically contacted with the lower surface of the cover of closed state is associated intimately with the upper end of the bottomed cylindrical container body. Thus, the container can by simply produced by readily associating the cover and the container body and can also assure the sealability between the cover and the body.

10 Claims, 6 Drawing Figures

CONTAINER HAVING SPRING BIASED HINGE

BACKGROUND OF THE INVENTION

This invention relates to a container in which a cover is coupled by hinges with a container body for simplifying the assembling of the cover with the body and assuring the sealing effect of the cover to the body.

A hinge structure in which a coiled spring is engaged with a hinge shaft has been heretofore employed as means for coupling a cover with a container body in some of the conventional containers.

In such a structure, the coiled spring is elastically contacted at one end thereof with part of the cover and at the other end thereof with part of the container body. The cover is opened from the body by the elastic force of the coiled spring in a circumferential direction when the cover is unlocked by a predetermined operation from a state in which the cover is locked on the container body.

However, in this structure, a hinge shaft should be inserted into shaft holes perforated at the cover and the container body while respectively locking the both ends of the coiled spring to the parts of the cover and the body. In addition, the hinge shaft should also be simultaneously inserted into the hole of the coiled spring. It is accordingly difficult to insert the hinge shaft while applying a resisting force against the elastic force of the coiled spring having the elastic force in the circumferential direction, and it is remarkably hard and complicated to position and insert the hinge shaft to the holes of the cover and the body as well as the coiled spring.

Further, in the container of the hinge structure described above, the cover should be constructed so that the hinge shaft must be rotated as a shaft. Therefore, if the cover and the container body are not associated in a predetermined margin, the cover cannot smoothly rotate with respect to the container body in opening and closing operations. As a result, a gap has to be formed between the cover and the container body. Consequently, it lacks the sealability between the cover and the body.

Therefore, in the conventional container having a tight sealability, the hinge coupling for opening and closing of the cover in the container cannot be employed between the cover and the container body; and a plug shape structure is engaged separately from the cap, for example, threaded to the container body. Such a conventional container is complicated to open and close the cover of the container body.

SUMMARY OF THE INVENTION

Accordingly, a object of the present invention is to provide a container which is improved to eliminate the above-described drawbacks and disadvantages of the conventional container and which can simply associate a cover and a container body and can also assure the sealability between the cover and the body.

According to the present invention, there is provided a container in which a recess for containing a coiled spring is formed at a shaft hole opening of one of a cover and a container body. A connecting portion for connecting the other end of the coiled spring is formed at the other of the cover and the body in such a manner that the connecting portion is substantially oppositely formed to the recess at the shaft hole opening. A connecting piece capable of temporarily connecting the other end of the coiled spring is formed. A packing elastically contacted with the lower surface of the cover of closed state is associated intimately with upper end of the bottomed cylindrical container body.

The above and other related objects and features of the invention will be apparent from a reading of the following description of the disclosure found in the accompanying drawings and the novelty thereof pointed out in the appended claims.

DESCRIPTION OF THE PREFERRED EMBODIMENTS

The present invention is described below in more detail with reference to the accompanying drawings.

Figure 1:
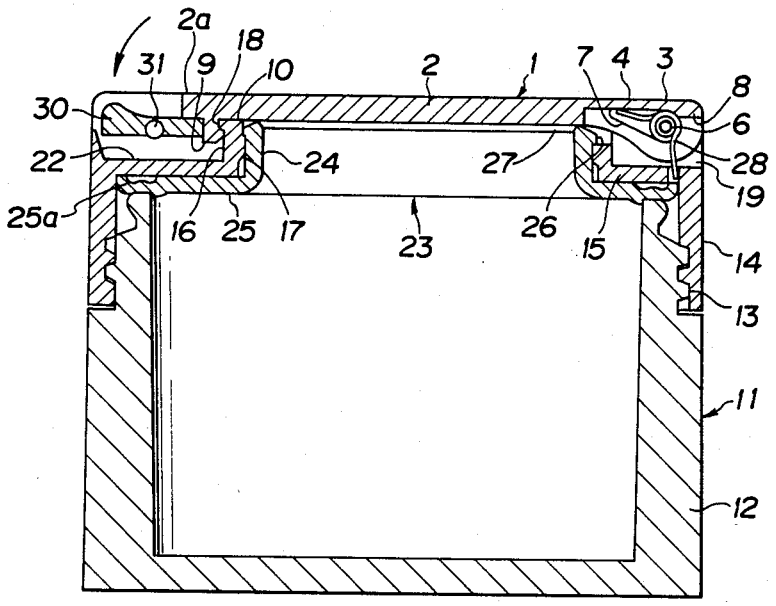
FIG. 1 is a longitudinal sectional view showing an embodiment of a container according to the present invention.
Figure 2:
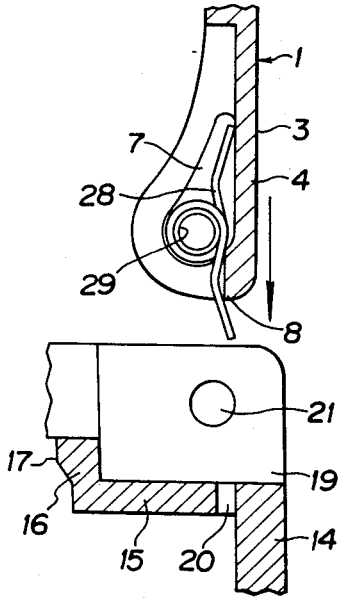
FIG. 2 is an enlarged sectional view showing the associating state of a cover and a container body.
Figure 3:
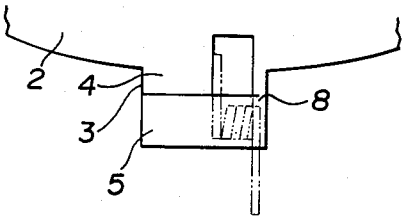
FIG. 3 is an enlarged front view showing a hinge piece portion of the cover.

In FIGS. 1 to 3, reference numeral 1 designates a cover, in which a hinge piece 3 is projected from the base end of a flat cover plate 2. The hinge piece 3 is constructed so that a cylindrical portion 4 formed with a shaft 6 is integrally attached to the inner surface of a flat portion 4 formed by extending the cover plate 2. One end of the cylindrical portion 5 has a large bore, and is formed with a recess 7 for containing a coiled spring 28 to be described in greater detail. The flat portion 4 is slightly projected sidewisely from the opening end of the recess 7 of the cylindrical portion 5, and is formed with a connecting piece 8.

A tongue piece 2*a* is extended from the end of the cover plate 2. A latch piece 9 is suspended from the lower surface of the tongue piece 2*a*, and a connecting strip 10 is formed on the rear surface of the latch piece 9.

Reference numeral 11 depicts a container. In the exemplified embodiment in FIGS. 1 to 3, the container 11 is constructed such that a mating cylinder 13 is threaded on the upper portion of a bottomed cylindrical container body 12. The cylinder 13 is formed circumferentially with an inner collar 15 on the upper end of the peripheral wall 14 of a short cylindrical shape. A short cylinder 16 is erected from the inner peripheral end of the inner collar 15. An engaging strip 17 is circumferentially formed on the inner peripheral surface of the upper end of the short cylinder 16, and a connecting strip 18 is projected from the outer peripheral surface of the upper portion of the short cylinder 16.

The peripheral wall 14 is notched at the upper end corresponding to the hinge piece 3 of the cover 1, and a mating recess 19 is formed with the inner collar 15. In the embodiment as described above in FIGS. 1 to 3, a hole is perforated as a connecting portion 20 at the inner collar 15 along the peripheral wall 14 in the mating recess 18, and a shaft hole 21 is further perforated at the peripheral wall 14 in the state opened at the center of the side surface of the recess 19.

An operating recess 22 is formed from the inner collar 15 of the end of the cylinder 14 of the container 11 to the peripheral wall 14, and a pressing piece 30 is associated rockably in a direction of an arrow by a shaft 31 laid in a circumferential direction of the inner collar 15 in the recess 22. The tongue piece 2a of the cover plate 2 is disposed in the recess 22 in the state that the cover 1 is closed, the connecting strip 10 of the tongue piece 2a is connected from below to the connecting strip 18 of the short cylinder 15 to maintain a closed state and the base end of the pressing piece 30 is contacted with the lower surface of the end of the tongue piece 2a.

In the container thus constructed as described above when the end of the pressing piece 30 exposed externally is rotated to be pressed downwardly, the pressing piece 30 operates to lift at the base end of the tongue piece 2a thereby releasing or disconnecting the connection of the strip 10 to the connecting strip 18.

Reference numeral 23 denotes a ring-shaped packing associated between the container 11 and the cover 1, which is formed of synthetic resin or rubber. The packing has an outer diameter equal to the bore of the short cylinder 16, and is formed circumferentially at the lower end of a cylindrical portion 24 having a height and width substantially equal to those of the short cylinder 16 with an outer collar 25 having an outer diameter substantially equal to the bore of the peripheral wall 14, formed circumferentially at the upper end of the cylindrical portion 24 with an elastic piece 27 of substantially conical shape reduced in diameter at the upper end in an inner collar shape, formed circumferentially at the peripheral end of the outer collar 25 with a sealing strip 25a bent and swelled downwardly, and formed at the outer periphery of the upper end of the cylindrical portion 24 with an engaging peripheral strip 26 to be engaged with the engaging strip 17 of the short cylinder 16.

The packing 23 thus constructed is intimately inserted from below into the cylinder 13, interposed at the outer collar 25 between the upper end of the opening cylinder and the inner collar 15 to the container body 12 when the cylinder 13 is threaded to the container body 12, thereby performing the sealing therebetween. Since the sealing strip 25a is formed oppositely to the opening cylinder, the strip 25a is elastically deformed at the interposed time thereby assuring the sealability therebetween.

The coiled spring 28 is extended from both ends of the coil molding wire in a radially linear manner and is projected at both ends to form extended ends. The spring is inserted and contained in the recess 7 of the shaft hole 6 in such a manner that the one end is elastically contacted with the flat portion 4 in the recess 7 and the other end is projected from the opening end of the recess 7 and elastically contacted with the connecting piece 8.

More particularly, the other end of the coiled spring 28 is elastically contacted with the connecting piece 8, thereby extending substantially along the extension line of the cover plate 2 as readily understood from FIG. 2.

The connecting piece 8 is opposed to the connecting portion 20 when the cover 1 is opposed to the recess 19 associated with the hinge piece 3 in the attitude opened peependicularly to the container 11 as described with in FIG. 2. In this manner, the other end of the coiled spring 28 associated in the hinge piece 3 is elastically contacted with the connecting piece 8 and projected toward the connecting portion 20.

Therefore, the hinge piece 3 of this attitude described above is inserted into the recess 19. The axial core of the shaft hole 6 of the hinge piece 3 is allowed to be coincident to the axial core of the shaft hole 21 of the container 11, the other end of the coiled spring 28 is elastically contacted with the connecting portion 20, the hinge shaft 29 is inserted from the outer end of the shaft hole 21 of the container 11. The cover 1 and the container 11 are associated.

In the embodiment as described above, the hole is perforated at the inner collar 15 to form the connecting portion 20. The present invention is not limited to this particular embodiment. For example, the upper surface itself of the inner collar 15 may be formed as the connecting portion 20.

Figure 4:
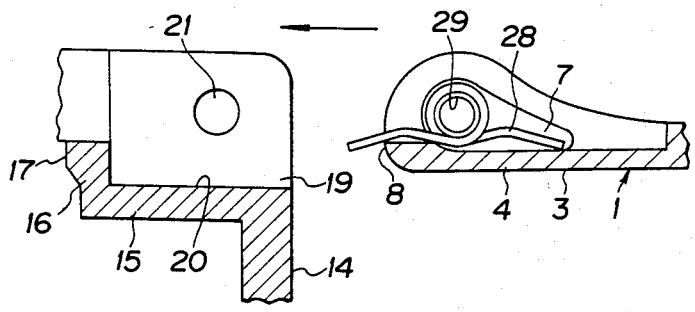
FIG. 4 is an enlarged partial sectional view showing another embodiment of a container according to the present invention.

More specifically, in this case, the cover 1 is disposed in the attitude inverted at 180° to the container 11, the hinge piece 3 is associated, and opposed at the rear of the recess 19. The connecting piece 8 is opposed to the connecting portion 20 as the upper surface of the inner collar 15. Thus, the other end of the coiled spring 28 is elastically contacted with the connecting piece 8 and projected toward the connecting portion 20. Consequently, the hinge piece 3 of this attitude is associated, inserted from the rear into the recess 19. The other end of the coiled spring 28 is elastically contacted with the connecting portion 20 in the same manner as described above, and the hinge shaft 29 is inserted (See FIG. 4).

Figure 5:
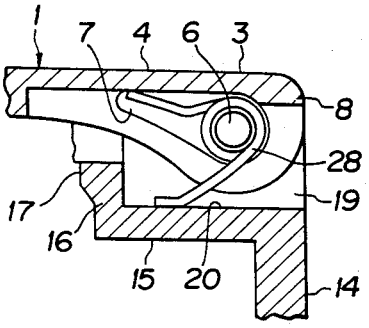
FIG. 5 is a sectional view showing part of the hinge structure of a container.
Figure 6:
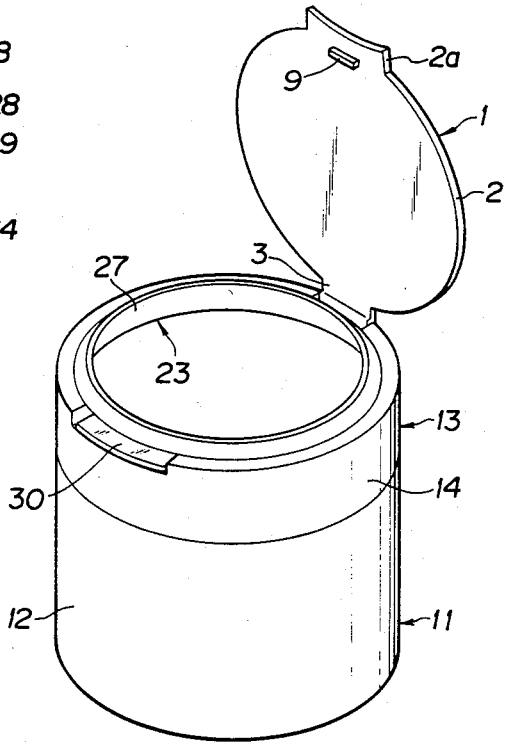
FIG. 6 is a perspective view entirely showing still another embodiment of a container according to the invention.

FIG. 5 shows another embodiment of the container according to the invention at the hinge structure in the associated state.

The packing 23 may be intimately inserted from below into the short cylinder 16 at the making cylinder 13 of the container 11. The engaging strip 17 is firmly engaged with the engaging peripheral strip 26 and the outer collar 25 is substantially planely contacted with the lower surface of the inner collar 15.

Since the inner collar 27 of the packing 23 is formed in a frustoconical shape in this state, the collar 27 is projected from the upper end of the short cylinder 16. But when the cover 1 is closed to connect the tongue piece 2a of the cover plate 2 to the recess 22 the upper end of the elastic piece 27 is intimately elastically contacted over the entire periphery with the lower surface of the cover plate 2 while elastically deforming.

The sealing strip 25a of the packing 23 is elastically deformed as it is disposed to oppose the upper end of the opening cylinder of the container 11 and the sealing strip 25a is contacted with the upper end of the opening cylinder when the cylinder 13 is threaded to the container 11.

In other words, when the packing 23 is associated together with the cylinder 13 and the container 11, the outer collar 25 is strongly interposed between the opening cylinder and the inner collar 15 to cause the sealing strip 25a to be crushed so as to be intimately associated with the container 11, and when the cover 1 is closed, the elastic piece 27 is intimately elastically contacted over the entire periphery with the lower surface of the cover plate 2, thereby tightly sealing between the cover and the container.

Since the coiled spring 28 is connected at both ends thereof within the recess 7 and the connecting portion 20 is elastically urged so as to open the cover 1 the cover 1 can be immediately opened when the connection between connecting strips 10 and 18 is disconnected by the operation of the pressing piece 30 as described above. In this case, the elastic recoiling force of the elastic piece 27 of the packing 23 elastically contacted with the lower surface of the cover plate 2 acts to aid the opening operation of the cover 1.

According to the present invention as described above, the hinge of the container of the invention for coupling by the hinge the cover 1 to the container 11 through the coiled spring 28 and the hinge shaft 29 the connecting piece 8 is provided opposite to the connecting portion 20 of the container 11 at the opening end of the recess 7 of the hinge piece 3 of the cover 1 for containing the coiled spring 28. Therefore, the coiled spring 28 at one end thereof connected into the recess 7 is temporarily connected at the other end thereof to the connecting piece 8 before the cover 1 is associated with the container 11. As a result the spring is prevented from falling due to the retention in the recess 7. Thus, when the cover 1 is associated with the hinge piece 3 in a perpendicular attitude to the container 11 and inserted into the recess 19, the coiled spring 28 is readily connected at the other end thereof to the connecting portion 20 in the state guided by the connecting piece 8, and the hinge shaft 29 can be engaged by bringing the shaft holes 6 and 21 and the axial center of the coiled spring 28 into coincidence with each other.

Further, it is advantageous that since the inner surface of the cover plate 2 is intimately contacted with the elastic piece 27 of the packing 23 when the cover 1 is closed, the container 11 can be firmly sealed.

According to the present invention as described above, the cover can be associated and the hinge shaft can be inserted in the state that the other end of the coiled spring is temporarily held in the desired attitude. Therefore, the assembly of the container can be remarkably simply carried out. The coiled spring can be effectively connected in a desired state, and even if the cover is associated through the hinge with the container, the container can be completely sealed by using the packing. Since the packing is not an intermediate cover shape, it is not necessary to open the cover plate for the use and to open the packing, thereby providing a simple structure and facilitating the construction.

What is claimed is:

1. A container, comprising a coiled spring, a hinge shaft engaged with the spring, a cover and a container body coupled with the cover through the hinge shaft engaged with the spring, a recess formed at a shaft hole opening of the cover and the container body for containing the coiled spring with one end of the spring connected thereto, a connecting portion formed at other end of the cover and the container body for connecting the other end of the coiled spring, a connecting piece disposed substantially opposite to the connecting portion at the recess opening end for temporarily connecting the other end of the coiled spring, and a packing of ring-shaped elastic material elastically contacted with lower surface of the cover over entire periphery at upper end thereof within the upper end of the container.

2. A container according to claim 1, wherein the cover is constructed so that a hinge piece is projected from base end of the cover plate and the hinge piece is constructed so that a cylindrical portion formed with a shaft hole is integrally attached to inner surface of a flat portion formed by extending the cover plate.

3. A container according to claim 2, further comprising a tongue piece extended from the other end of the cover plate, a latch piece is suspended from lower surface of the tongue piece and a connecting strip is formed on rear surface of the latch piece.

4. A container according to claim 3, wherein a mating cylinder is threaded on upper portion of the container body and is formed circumferentially with an inner collar on an upper end of a peripheral wall of a short cylindrical shape, a short cylinder is erected from inner peripheral end of the inner collar, an engaging strip is circumferentially formed on an inner peripheral surface of upper end of the short cylinder and a connecting strip is projected from an outer peripheral surface of upper portion of the short cylinder.

5. A container according to claim 4, wherein the peripheral wall is notched at the upper end corresponding to the hinge piece of the cover and a mating recess is formed with the inner collar.

6. A container according to claim 5, further comprising an operating recess formed from the inner collar at the end of a cylindrical wall of the container to peripheral wall and a pressing piece is rockably associated by a shaft laid in a circumferential direction of the inner collar in the operating recess so that the tongue piece of the cover plate is disposed in the operating recess in a state that the cover is closed, a connecting strip of the tongue piece is connected from below to a connecting strip of the strip cylinder to maintain a closed state and base end of the pressing piece is contacted with lower surface of an end of the tongue piece.

7. A container according to claim 6, wherein said packing has an outer diameter substantially equal to bore of the short cylinder and is formed circumferentially at lower end of a cylindrical portion having a height and width substantially equal to that of the short cylinder with an outer collar of an outer diameter substantially equal to bore of the peripheral wall, formed circumferentially at upper end of the cylindrical portion with an elastic piece of substantially conical shape reduced in diameter at the upper end in an inner collar shape, formed circumferentially at peripheral end of the outer collar with a sealing strip bent and swelled downwardly and formed at outer periphery of the upper end of the cylindrical portion with an engaging peripheral strip to be engaged with the engaging strip of the short cylinder.

8. A container according to claim 7, wherein said packing is intimately inserted from below into the mating cylinder, interposed at the outer collar between the upper end of the opening cylinder and the inner collar of the container body when the mating cylinder is threaded to the container body.

9. The container according to claim 7, wherein said packing is intimately inserted from below into the short cylinder at the mating cylinder of the container body, the engaging strip is firmly engaged with the engaging peripheral strip and the outer collar is substantially planely contacted with lower surface of the inner collar.

10. The container according to claim 9, wherein the inner collar of said packing is formed in a frustoconical shape, and is projected from upper end of the short cylinder.

* * * * *